US006241420B1

(12) United States Patent
Perrin et al.

(10) Patent No.: US 6,241,420 B1
(45) Date of Patent: Jun. 5, 2001

(54) CONTROL SYSTEM FOR A VIBRATORY COMPACTOR

(75) Inventors: Jacques Perrin, Gournay; Gerard Debrock, Rantigny, both of (FR)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 09/387,106

(22) Filed: Aug. 31, 1999

(51) Int. Cl.[7] ..... E01C 23/07; E01C 19/38

(52) U.S. Cl. ..... 404/84.1; 404/117; 91/529; 60/374; 60/394; 60/422; 60/424; 60/484; 60/494

(58) Field of Search ..... 404/84.1, 102, 404/117, 122, 133.05; 91/520, 528, 529; 60/369, 374, 375, 394, 395, 422, 424, 464, 484, 494

(56) References Cited

U.S. PATENT DOCUMENTS

| | | | | |
|---|---|---|---|---|
| 3,435,616 | | 4/1969 | Waldorff | 60/97 |
| 3,641,764 | * | 2/1972 | Destefan et al. | 60/484 |
| 3,733,964 | * | 5/1973 | Schantz | 91/412 |
| 3,870,427 | * | 3/1975 | Allen | 404/103 |
| 3,872,674 | | 3/1975 | Verlinde | 60/706 |
| 3,916,624 | | 11/1975 | Machens et al. | 60/394 |
| 4,187,036 | * | 2/1980 | Haker et al. | 404/117 |
| 4,568,218 | | 2/1986 | Orzal | 404/117 |
| 4,619,552 | | 10/1986 | Sadahiro | 404/117 |
| 4,679,764 | * | 7/1987 | Smith et al. | 251/14 |
| 4,694,649 | | 9/1987 | Howeth | 60/468 |
| 4,746,264 | * | 5/1988 | Kishi et al. | 414/687 |
| 4,773,217 | * | 9/1988 | Angot et al. | 60/444 |
| 5,082,396 | * | 1/1992 | Polacek | 404/117 |
| 5,248,216 | * | 9/1993 | Vural | 404/75 |
| 5,390,495 | * | 2/1995 | Lemaire | 60/442 |
| 5,397,198 | * | 3/1995 | Bertrand | 404/117 |
| 5,781,874 | * | 7/1998 | Troppman et al. | 701/50 |

* cited by examiner

*Primary Examiner*—Thomas B. Will
*Assistant Examiner*—Gary S. Hartmann
(74) *Attorney, Agent, or Firm*—Jeff A. Greene

(57) ABSTRACT

A fluid control system (50) is provided for a work machine (10) having first and second compacting drums (14,16). First and second hydraulic motors (28,32) are connected in series and power first and second vibratory mechanisms (26,30) located within the first and second compacting drums (14, 16). A control valve (60) supplies pressurized fluid to the first hydraulic motor (28). The pressurized fluid is transferred through a bypass circuit (74) around the second hydraulic motor (32). A sequencing device (80) closes the bypass circuit (74) transferring the pressurized fluid to the second hydraulic motor (32) after actuation of the first hydraulic motor (28).

15 Claims, 4 Drawing Sheets

CONTROL SYSTEM FOR A VIBRATORY COMPACTOR

CONTROL SYSTEM FOR A VIBRATORY COMPACTOR

1. Technical Field

This invention relates to a vibratory compacting machine and, more particularly, to a control system for actuation of the vibratory mechanisms.

2. Background Art

Vibratory compactors typically comprise rotatable drums that are oscillated or vibrated to impose compaction forces on a compactable surface, such as ground soil, roadway base, or paving material. Generally the compacting machine includes an engine that is mounted on a main frame to which the rotatable drums are resiliently mounted.

Vibratory mechanisms or eccentric masses mounted inside the drums are used to create these compaction forces. A fluid pump connected to the engine is used to power hydraulic motors to rotate the eccentric masses. During initial start up a large amount of energy is required from the engine to rotate the eccentric masses from a static state. This initial draw on the engine creates a noticeable drawdown on the engine. If the machine is being propelled on an incline, starting or excitation of the eccentric masses can cause the engine to stall. This requires either the engine to be oversized to meet the full application needs of the machine or a system that controls the initial start-up of the eccentric masses.

The present invention is directed to overcoming one or more of the problems as set forth above.

DISCLOSURE OF THE INVENTION

In one aspect of the present invention a fluid control system is provided for a work machine. The work machine has first and second compacting drums rotatably mounted on a main frame. The main frame supports an engine that has a pump connected thereto. The first and second compacting drums respectively include first and second vibratory mechanisms. The fluid control system comprises a first and a second hydraulic motor. The first hydraulic motor is connected to the pump and operatively connected to the first vibratory mechanism. The second hydraulic motor is connected in series with the first hydraulic motor and operatively connected with the second vibratory mechanism. A fluid control valve is disposed between and connected to the pump and the first hydraulic motor. A bypass valve is connected to the first and second hydraulic motors. A sequencing device is responsive to actuation of the fluid control valve and is connected to the bypass valve and controls actuation of said second hydraulic motor.

In another aspect of the present invention a method is provided for controlling the excitation of a first vibratory mechanism and a second vibratory mechanism. The method comprises the steps of actuating the first vibratory mechanism of the work machine and actuating the second vibratory mechanism of the compacting machine dependant on a predetermined amount of time or a predetermined event.

BEST MODE FOR CARRYING OUT THE INVENTION

Figure 1:
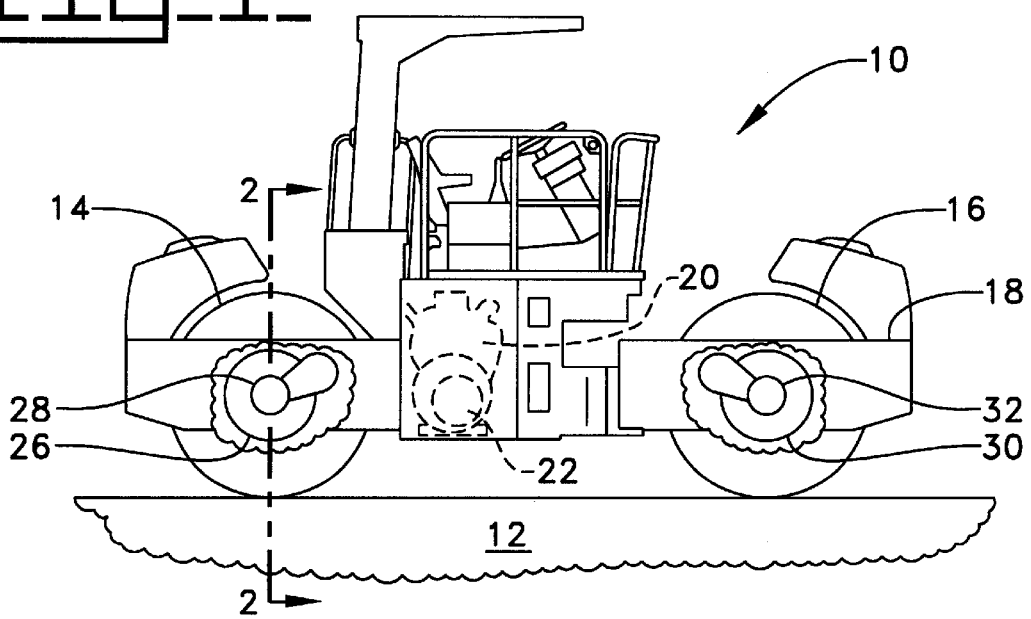
FIG. 1 is a side elevational view of a machine embodying the present invention.

A work machine 10 for increasing the density of a compactable material 12 such as soil, gravel, or bituminous mixtures an example of which is shown in FIG. 1. The work machine 10 is for example, a double drum vibratory compactor, having a first compacting drum 14 and a second compacting drum 16 rotatably mounted on a main frame 18. The main frame 18 also supports an engine 20 that has a pump 22 conventionally connected thereto.

The first compacting drum 14 includes a first vibratory mechanism 26 that is operatively connected to a first hydraulic motor 28. The second compacting drum 16 includes a second vibratory mechanism 30 that is operatively connected to a second hydraulic motor 32. It should be understood that the first and second compacting drums 14,16 might have more than one vibratory mechanism per drum without departing from the spirit of the present invention.

Figure 2:
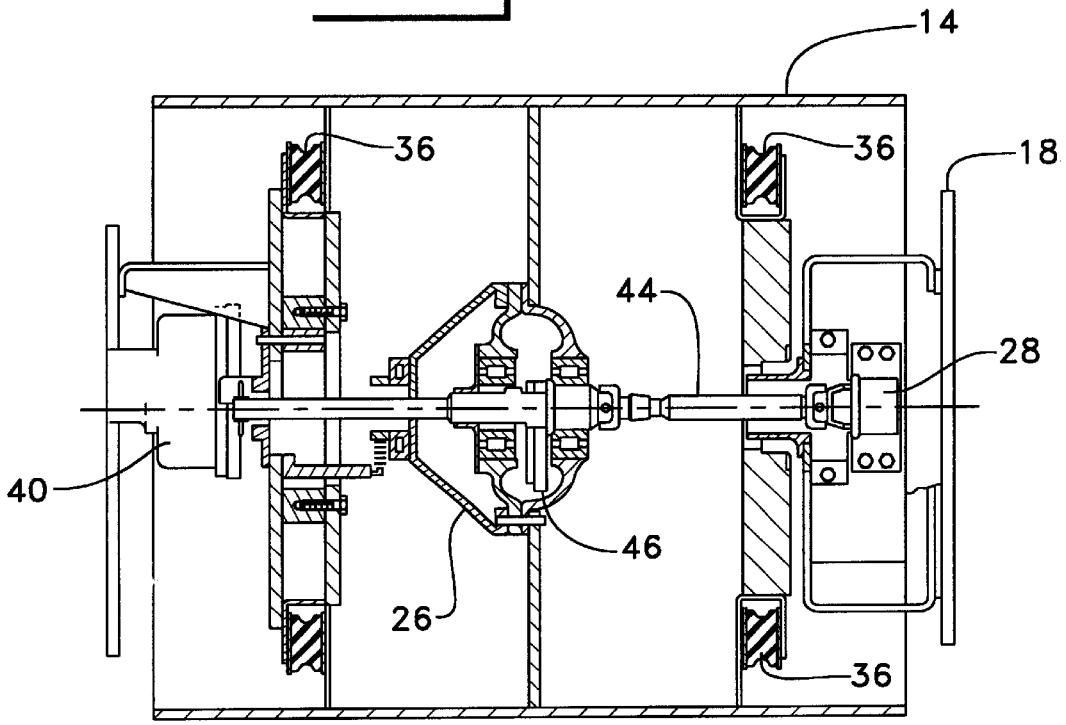
FIG. 2 is an enlarged cut away view of a single vibratory drum.

In as much as the first compacting drum 14 and the second compacting drum 16 are structurally and operatively similar. The description, construction and elements comprising the first compacting drum 14, as shown in FIG. 2, applies equally to the second compacting drum 16. Rubber mounts 36 vibrationally isolate compacting drum 14 from the main frame 18. The compacting drum 14 includes a fluid drive motor 40 that is connected by hoses or conduits, not shown, to the pump 22. For example, the fluid motor 40 is connected to the main frame 18 and operatively connected to the first compacting drum 14. Pump 22 supplies a pressurized operation fluid, such as oil to the fluid drive motor 40 for propelling the work machine 10. A shaft 44 connects the first vibratory mechanism 26 to the first hydraulic motor 28. The first vibratory mechanism 26 includes an eccentric mass 46 that is powered by the first hydraulic motor 28 thereby imparting a vibratory force on the compacting drum 14.

Figure 3:
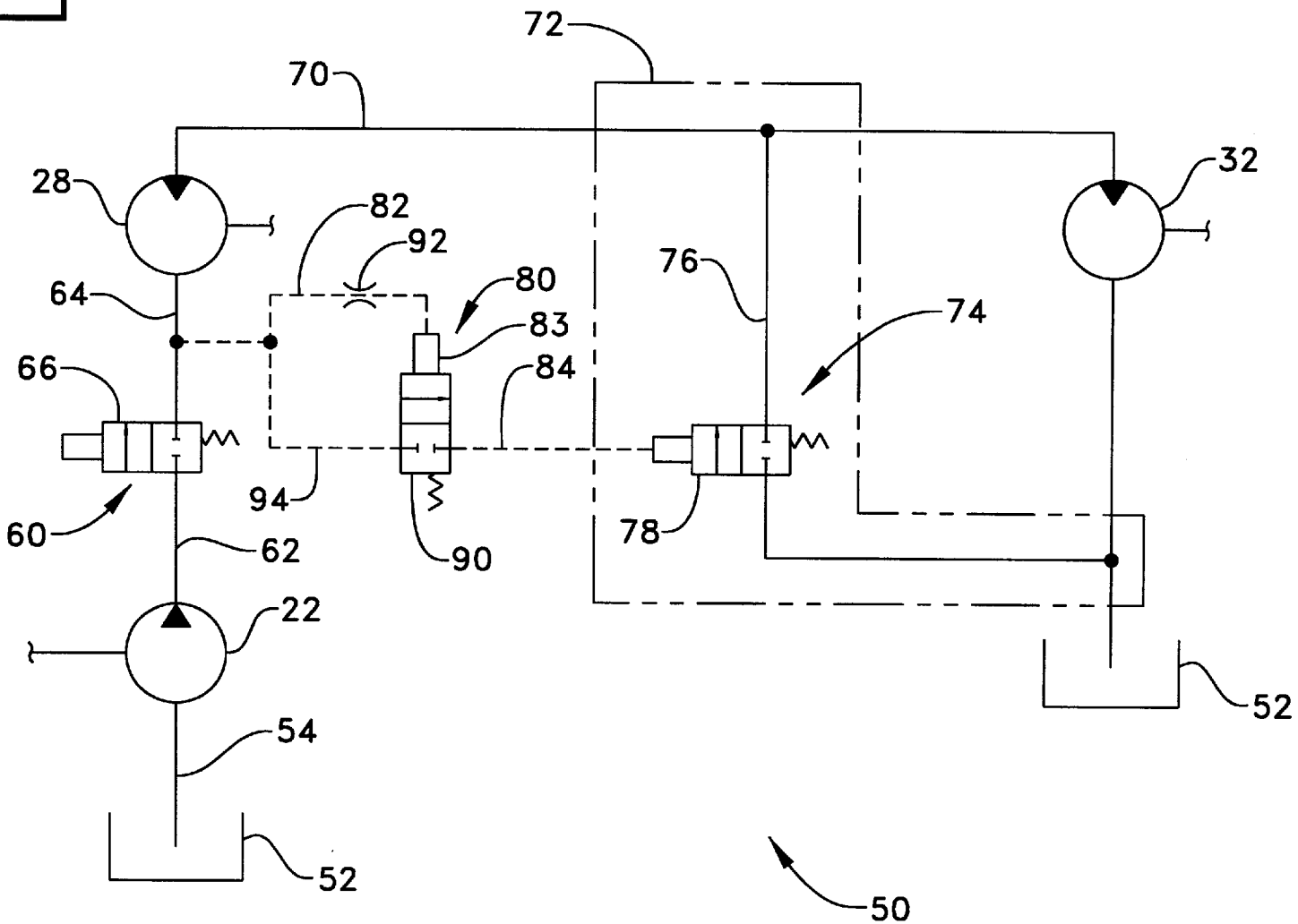
FIG. 3 is a schematic view of a first embodiment of a fluid control system for the vibratory mechanisms of the compacting machine in FIG. 1.
Figure 4:
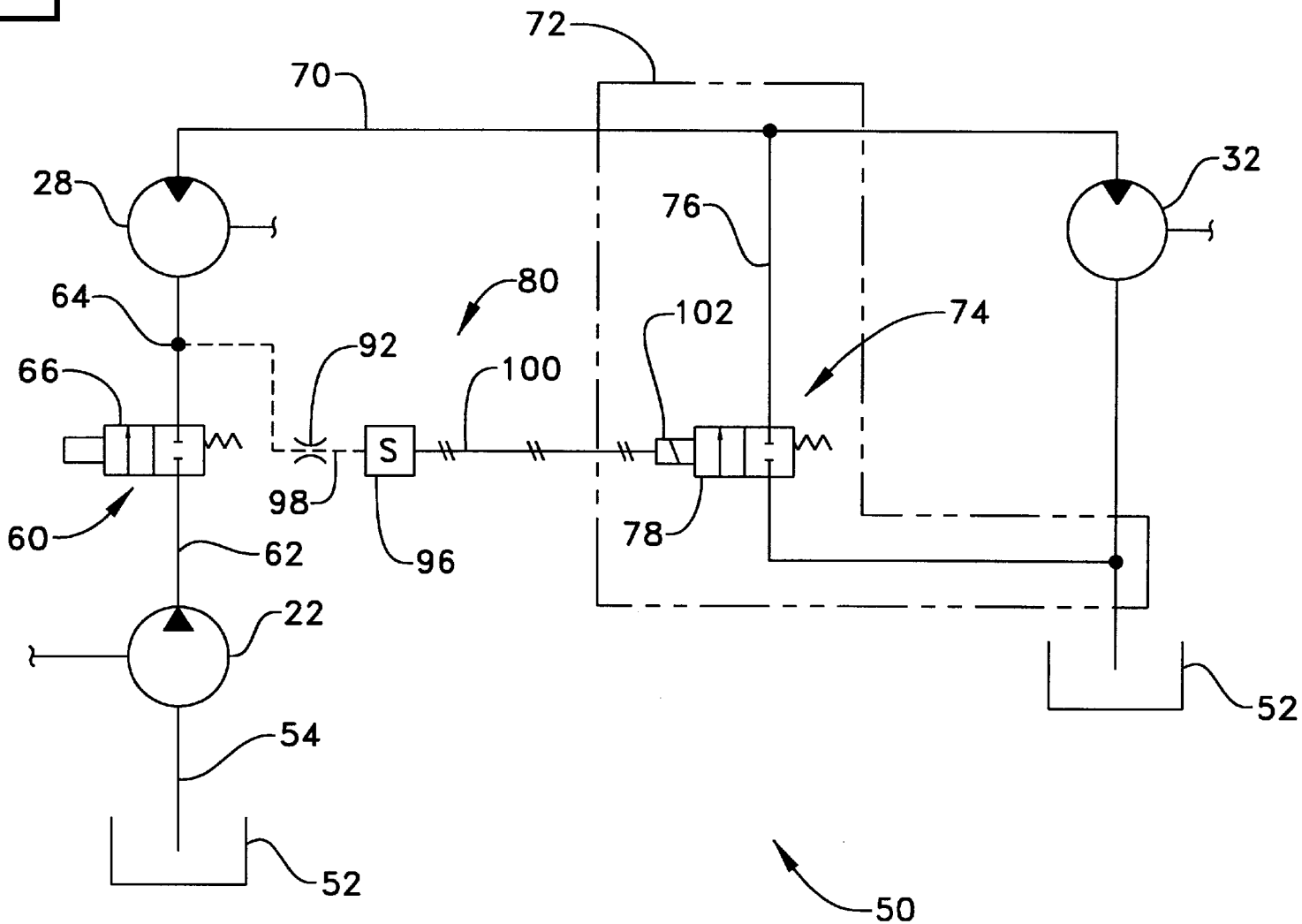
FIG. 4 is a schematic view of a second embodiment of a fluid control system for the vibratory mechanisms of the compacting machine in FIG. 1.
Figure 5:
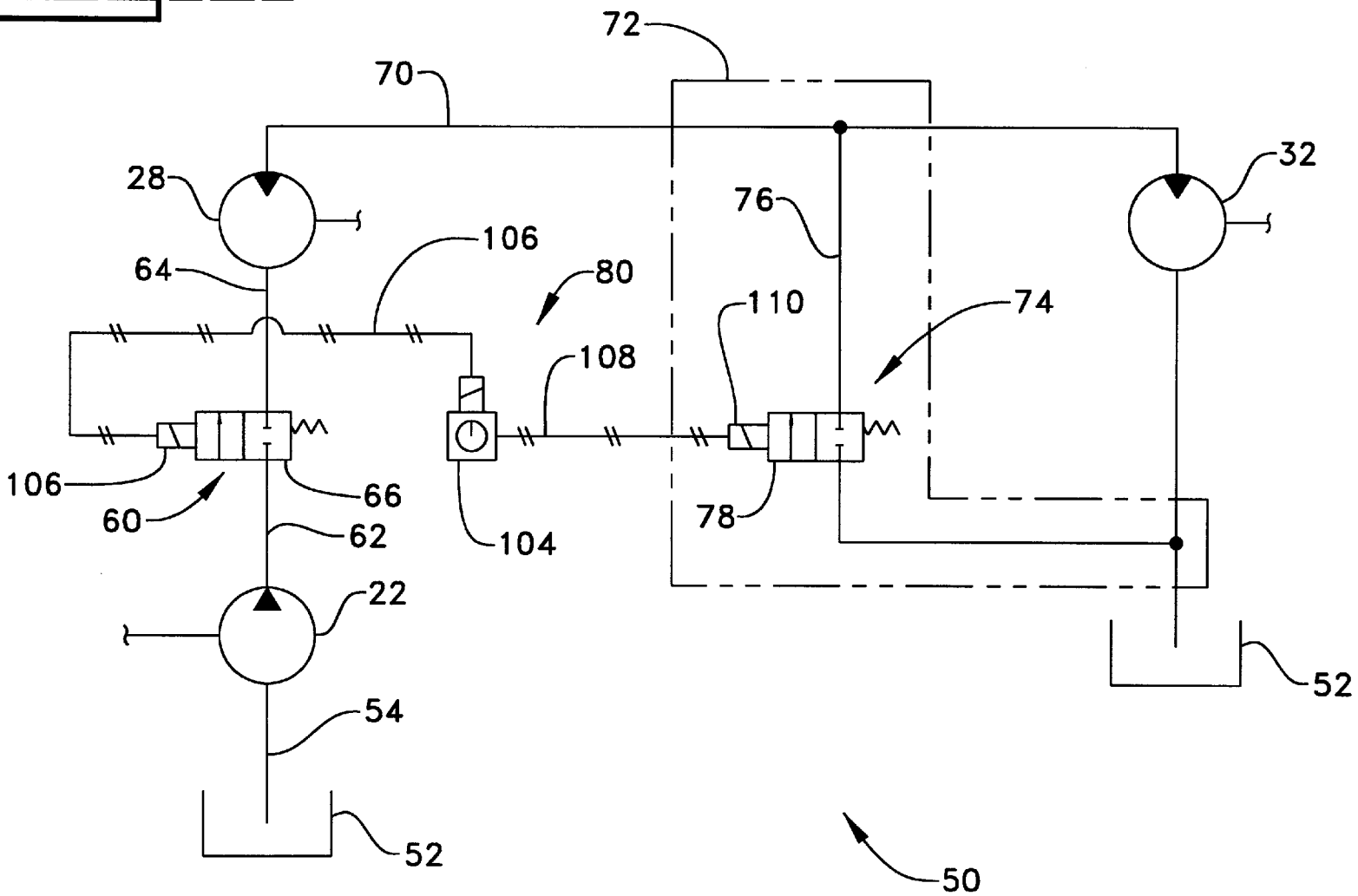
FIG. 5 is a schematic view of a third embodiment of a fluid control system for the vibratory mechanisms of the compacting machine in FIG. 1.

Now referring to FIG. 3, a fluid control system 50 is shown for controlling the first hydraulic motor 28 and the second hydraulic motor 32. The pump 22 is connected to a fluid reservoir 52 by a fluid conduit 54. A fluid control valve 60 is connected to the pump 22 by fluid conduit 62. The first hydraulic motor 28 is connected to the fluid control valve 60 by a fluid conduit 64. Fluid control valve 60 is, for example, a normally closed two-position valve 66 that can be actuated manually, electrically, or by pilot control to permit the flow of operation fluid. It should be understood that fluid control valve 60 could be any fluid control valve without departing from the spirit of the present invention.

The second hydraulic motor 32 is connected in series to the first hydraulic motor 28 by a fluid conduit 70. A bypass circuit 72 is connected to fluid conduit 70 between the first hydraulic motor 28 and the second hydraulic motor 32. The bypass circuit 72 includes a bypass valve 74 that is connected to fluid conduit 70 by a fluid conduit 76. Bypass valve 74 is, for example, a normally open two-position valve 78 that is actuated to check the flow of operation fluid by fluid pilot, electric or manual actuation.

Industrial Applicability

In operation the fluid control system 50 controls the propulsion of the work machine 10 and the actuation of the first and the second vibratory mechanisms 26,30. For example, as the work machine 10 begins to traverse over the compactable material 12 the operator sends a command signal, which can be manual, hydraulic, or electronic, to the fluid control valve 60. Fluid control valve 60 shifts from the normally closed position to permit the flow of pressurized operation fluid. The flow of pressurized operation fluid starts the first hydraulic motor 28, which rotates shaft 40 actuating the first vibratory mechanism 26.

In the first embodiment, when the fluid control valve 60 is actuated operation fluid is transmitted through pilot signal line 82 to the sequencing device 80, which in this embodiment is the fixed orifice 92 and the pilot operated valve 90. The operation fluid is transmitted through the fixed orifice 92 to actuate the pilot operated valve 90. The fixed orifice 92 serves to delay the actuation of the pilot operated valve 90. After a predetermined amount of time the pilot operated valve 90 is actuated allowing the flow of fluid to actuate the bypass valve 74. The bypass valve 74 receives the fluid pilot signal and shifts from the normally open position to a closed position checking the flow of operation fluid to the reservoir 52. The operation fluid is thereby diverted to and causes the second hydraulic motor 32 to turn thereby actuating the second vibratory mechanism 30.

In the second embodiment, when the fluid control valve 60 is actuated, operation fluid is transmitted through pilot signal line 98 to the sequencing device 80, which in this embodiment is the fixed orifice 92 and the pressure switch 96. The operation fluid is transmitted through the fixed orifice 92 to actuate the pilot operated valve 90. The fixed orifice 92 serves to delay the actuation of the pressure switch 96. After a predetermined amount of time the pressure switch 96 is actuated, sending an electrical signal through electrical conductor 100 to the solenoid 102 of the bypass valve 74. The bypass valve 74 receives the electrical signal and shifts from the normally open position to a closed position checking the flow of operation fluid to the reservoir 52. The operation fluid is routed to and causes the second hydraulic motor 32 to turn thereby actuating the second vibratory mechanism 30.

In the third embodiment, the flow control valve 60 is actuated by an electrical signal energizing the solenoid 106. This electrical signal actuates the timer 104. After a predetermined amount of time determined by the setting on the timer 104 an electrical signal is transmitted through electrical conductor 108 to the solenoid 110 of the bypass valve 74. The bypass valve 74 receives the electrical signal then shifts from the normally open position to a closed position checking the flow of operation fluid to the reservoir 52. The operation fluid is routed to and causes the second hydraulic motor 32 to turn thereby actuating the second vibratory mechanism 30.

Thus a fluid control system 46 is provided for sequencing the excitation of the first and second vibratory mechanisms 26,30 reducing the drawdown on the engine 20. The fluid control system 50 starts the first hydraulic motor 28 actuating the first vibratory mechanism 26. A sequencing device 80 provides a predetermined amount of time delay or waits for a predetermined event and then signals the bypass valve 74 to close so that operation fluid is delivered to the second hydraulic motor 32 thereby actuating the second vibratory mechanism 30.

Other aspects, objects, and features of the present invention can be obtained from a study of the drawings, the disclosure, and the appended claims.

What is claimed is:

1. A fluid control system (50) in a work machine (10) having first and second compacting drums (14,16) rotatably mounted on a main frame (18), said main frame (18) supporting an engine (20) and a pump (22) connected thereto, said first and second compacting drums (14,16) including first and second vibratory mechanisms (36,38) respectively, said fluid control system (50) comprising;

a first hydraulic motor (42) connected to the pump (22) and operatively connected to the first vibratory mechanism (36);

a second hydraulic motor (44) connected in series with said first hydraulic motor (42) and operatively connected with the second vibratory mechanism (38);

a fluid control valve (60) being interposed to the pump (22) and said first hydraulic motor (42);

a bypass valve (74) being connected to said first and second hydraulic motors (42,44); and a sequencing device (80) responsive to actuation of said fluid control valve (60) and connected to said bypass valve (74), said sequencing device (80) controlling actuation of said second hydraulic motor (44).

2. The fluid control system (50) of claim 1 wherein the bypass valve (74) is a normally open control valve (78).

3. The fluid control system (50) of claim 2 wherein said bypass valve (74) is pilot operated.

4. The fluid control system (50) of claim 1 wherein the bypass valve (78) is operated by a solenoid (102).

5. The fluid control system (50) of claim 1 wherein the sequencing device (80) is pilot operated and receives a signal from a pilot signal line (82).

6. The fluid control system (50) of claim 1 wherein the sequencing device (80) is a pressure switch (96).

7. The fluid control system (50) of claim 1 wherein the sequencing device (80) is a pilot operated valve (90).

8. The fluid control system (50) of claim 1 wherein the sequencing device (80) is electrically actuated in response to energizing a solenoid (106).

9. The fluid control system (50) of claim 1 wherein the sequencing device (80) is a timer (104).

10. A compacting machine (10) comprising:

a main frame (18);

an engine (20) being supported by the main frame (18)

a pump (22) operatively connected to the engine (20);

first and second compacting drums (14,16) being rotatably connected to the main frame (18) of the compacting machine (10);

first and second vibratory mechanisms (36,38) being rotatably mounted within said first and second compacting drums (14,16) respectively;

a first hydraulic motor (42) being operatively connected to said first vibratory mechanism (36);

a second hydraulic motor (44) being fluidly connected in series with said first hydraulic motor (42) and being operatively connected to said second vibratory mechanism (38);

a fluid control valve (60) disposed between and connected to said pump (22) and to said first hydraulic motor (42);

a bypass circuit (72) interposed said first and second hydraulic motors (42,44); and a sequencing device (80) responsive to actuation of said fluid control valve (60) and operatively connected to said bypass circuit (72).

11. The compacting machine (10) of claim 10 wherein said bypass circuit (72) further includes a normally open control valve (78).

12. The compacting machine (10) of claim 11 wherein said normally open flow control valve (78) is pilot operated.

13. The compacting machine (10) of claim 10 wherein the sequencing device (80) is a timer (104).

14. The compacting machine (10) of claim 10 wherein the sequencing device (80) is a pressure switch (96).

15. The compacting machine (10) of claim 10 wherein the sequencing device (80) is a pilot operated valve (90).

* * * * *